US008340566B2

(12) United States Patent
Jeong

(10) Patent No.: US 8,340,566 B2
(45) Date of Patent: Dec. 25, 2012

(54) DISCHARGE UNIT INCLUDING FEEDING GUIDE AND IMAGE FORMING APPARATUS HAVING THE SAME

(75) Inventor: Seung-sik Jeong, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 744 days.

(21) Appl. No.: 12/099,964

(22) Filed: Apr. 9, 2008

(65) Prior Publication Data

US 2009/0039584 A1 Feb. 12, 2009

(30) Foreign Application Priority Data

Aug. 9, 2007 (KR) ..... 10-2007-0080170

(51) Int. Cl.
*G03G 15/00* (2006.01)
*B65H 29/54* (2006.01)

(52) U.S. Cl. ..... 399/401; 399/405; 271/301; 271/303

(58) Field of Classification Search ..... 399/401, 399/405; 271/3.18, 3.2, 189, 291–293, 303–306, 271/65, 301; 400/642; 74/89.23, 89.37, 74/424.71, 424.95, 424.96
See application file for complete search history.

(56) References Cited

U.S. PATENT DOCUMENTS 4,741,165 A * 5/1988 Kobus ..... 60/700
5,921,687 A * 7/1999 Koike et al. ..... 400/120.01
5,937,702 A * 8/1999 Erikson et al. ..... 74/424.95
6,185,380 B1 * 2/2001 Abe et al. ..... 399/18
6,331,004 B1 * 12/2001 Katou et al. ..... 271/301
6,862,428 B2 * 3/2005 Sasaki ..... 399/401
2003/0140720 A1 * 7/2003 Krause ..... 74/424.71
2005/0254872 A1 * 11/2005 Nonaka et al. ..... 399/401
2006/0203271 A1 * 9/2006 Su et al. ..... 358/1.12

FOREIGN PATENT DOCUMENTS

JP 05147771 A * 6/1993

OTHER PUBLICATIONS

Chinese Office Action mailed Sep. 15, 2011 for counterpart Chinese Patent Application No. 2008101354277.

* cited by examiner

*Primary Examiner* — Judy Nguyen
*Assistant Examiner* — Justin Olamit
(74) *Attorney, Agent, or Firm* — Staas & Halsey LLP

(57) ABSTRACT

An image forming apparatus includes: a casing; a printing medium supply unit, which is coupled to the casing, and supplies a printing medium; an image forming unit, which forms an image on the printing medium supplied from the printing medium supply unit; and a discharge unit. The discharge unit includes: a discharging part, which discharges the printing medium fed from the image forming unit out of the casing; a feeding guide, which is provided along in a feeding path of the printing medium, and moves between a discharging position, in which the printing medium is discharged out of the casing, and a back feeding position, in which the printing medium is back fed to the image forming unit; and a pressing lever, which presses and releases the feeding guide, according to a movement of the discharging part, so that the feeding guide can move between the discharging position and the back feeding position.

24 Claims, 12 Drawing Sheets

DISCHARGE UNIT INCLUDING FEEDING GUIDE AND IMAGE FORMING APPARATUS HAVING THE SAME

CROSS-REFERENCE TO RELATED APPLICATION

This application claims the benefit of Korean Application No. 2007-80170, filed Aug. 9, 2007 in the Korean Intellectual Property Office, the disclosure of which is incorporated herein by reference.

BACKGROUND OF THE INVENTION

1. Field of the Invention

Aspects of the present invention relate to a discharge unit, and an image forming apparatus having the same, and more particularly, to a discharge unit which can reduce noise generated when a printing medium is discharged, and an image forming apparatus having the same.

2. Description of the Related Art

In general, a discharge unit is employed in an image forming apparatus, to discharge a printing medium, such as, printing paper, wallpaper, transparencies, or the like, on which an image, such as, a pattern, text, or the like, is formed.

FIG. 1 is a schematic diagram illustrating a discharging process of a printing medium Pa, in a conventional image forming apparatus 10. As shown, an image is formed on the printing medium Pa, by an image forming unit (not shown), and is then fed to a discharging roller 40, after passing through a fusing unit 30. In this feeding process, the printing medium Pa is sharply bent between the discharging roller 40 and the fusing unit 30. A trailing edge Pe of the printing medium Pa collides with a wall surface of a casing 20, after passing through the fusing unit 30, as the printing medium Pa attempts to return to its original flat shape. As a width h of a feeding path of the printing medium Pa is increased, noise generated due to the collision with the wall surface of the casing 20, increases.

To overcome the above problem, it is possible to reduce the width h of the feeding path of the printing medium. However, the trailing edge Pe may collide with the wall surface of the casing 20, when the printing medium Pa is back fed in the direction of a dotted arrow b, for duplex printing, thereby obstructing the back feeding, or causing a jam.

SUMMARY OF THE INVENTION

Accordingly, an aspect of the present invention provides a discharge unit, and an image forming apparatus having the same, which can reduce noise generated when a printing medium is discharged to the outside, and which can stably discharge the printing medium.

Another aspect of the present invention provides a discharge unit, and an image forming apparatus having the same, which can provide smooth, interference-free back feeding of a printing medium, when the printing medium is fed backwards (back fed), during duplex printing.

The foregoing and/or other aspects of the present invention can be achieved by providing an image forming apparatus including a casing, a printing medium supply unit coupled to the casing, to supply a printing medium, an image forming unit to form an image on the printing medium supplied from the printing medium supply unit, and a discharge unit to discharge the printing medium fed from the image forming unit, outside of the casing, or to back feed the printing medium to the image forming unit. The discharge unit includes a discharging part to discharge the printing medium fed from the image forming unit, outside of the casing, a feeding guide provided along a feeding path of the printing medium, which moves between a discharging position, in which the printing medium is discharged out of the casing, and a back feeding position, in which the printing medium is back fed to the image forming unit, and a pressing lever to press and release the feeding guide, depending on the action of the discharging part, so that the feeding guide can move between the discharging position and the back feeding position.

According to aspects of the present invention, the feeding guide may be disposed further from the casing, while in the discharging position, and may be disposed closer to the casing, when in the back feeding position.

According to aspects of the present invention, the feeding guide may be in the back feeding position, when the pressing lever contacts the feeding guide, and may be in the discharging position, when the pressing lever is spaced apart from the feeding guide.

According to aspects of the present invention, the discharging part may include: a rotation shaft, and a discharging roller, which is coupled to the rotation shaft, and feeds the printing medium.

According to aspects of the present invention, the image forming apparatus may further include a movement change part, which is provided between the discharging part and the pressing lever, and changes the rotational movement of the discharging part, to match a linear movement of the pressing lever.

According to aspects of the present invention, the movement change part may include: a worm gear provided on the rotation shaft; and a slider disposed between the rotation shaft and the pressing lever. The slider moves between a first position, corresponding to the back feeding position, and a second position, corresponding to the discharging position.

According to aspects of the present invention, the worm gear may include a stopper that regulates the movement of the slider.

According to aspects of the present invention, the pressing lever may include: a lever body that moves together with the slider; and a biasing part that is provided between the lever body and the slider, to bias the slider toward the worm gear.

According to aspects of the present invention, the lever body may include a contact part that contacts the feeding guide, when the slider is positioned in the first position on the rotation shaft, and is spaced apart from the feeding guide, when the slider is positioned in the second position on the rotation shaft.

According to aspects of the present invention, the feeding guide may include: a rotatable feeding guide body; and a lever contact member that extends from the feeding guide body, and contacts the contact part of the lever body when the slider is in the first position, and is spaced apart from the contact part of the lever body when the slider is in the second position.

According to aspects of the present invention, the contact part of the lever body, and the lever contact member of the feeding guide, each may comprise corresponding inclined surfaces.

The foregoing and/or other aspects of the present invention can be also achieved by providing a discharge unit for an image forming apparatus that includes: a casing; a printing medium supply unit coupled to the casing, to supply a printing medium; an image forming unit to form an image on the printing medium, which is supplied from the printing medium supply unit; a discharge unit to discharge the printing medium, which is fed from the image forming unit, out of the casing, or to back feed the printing medium to the image forming unit. The discharge unit includes: a rotatable discharging part to discharge the printing medium, which is fed from the image forming unit, out of the casing; a feeding guide provided along a feeding path of the printing medium, to move between a discharging position, in which the printing medium is discharged out of the casing, and a back feeding position, in which the printing medium is back fed to the image forming unit; and a pressing lever to press and release the feeding guide, depending on a motion of the discharging part, so that the feeding guide can move between the discharging position and the back feeding position.

According to aspects of the present invention, the feeding guide may be disposed further from the casing, when in the discharging position, and may be disposed closer to the casing, when in the back feeding position.

According to aspects of the present invention, the feeding guide may be in the back feeding position, when the pressing lever contacts the feeding guide, and may be in the discharging position, when the pressing lever is spaced apart from the feeding guide.

According to aspects of the present invention, the discharging part may include: a rotation shaft, and a discharging roller coupled to the rotation shaft, to discharge the printing medium.

According to aspects of the present invention, the image forming apparatus may further include a movement change part provided between the discharging part and the pressing lever, to change the rotational movement of the rotation shaft, to match a linear movement of the pressing lever.

According to aspects of the present invention, the movement change part includes a worm gear provided on one of the rotation shaft and the pressing lever, and a slider provided on the other one of the rotation shaft and the pressing lever, and which slides between a first position corresponding to the back feeding position, and a second position corresponding to the discharging position.

According to aspects of the present invention, the lever body may include a contact part, which contacts the feeding guide, when the slider is positioned in the first position on the rotation shaft, and which is spaced from the feeding guide, when the slider is positioned in the second position on the rotation shaft.

According to aspects of the present invention, the pressing lever may include: a lever body that moves together with the slider; and a biasing part disposed between the lever body and the slider, to bias the slider toward the worm gear.

According to aspects of the present invention, the feeding guide may include: a rotatable feeding guide body; and a lever contact member that extends from the feeding guide body. The lever contact member contacts the contact part of the lever body, when the slider is in the first position, and is spaced from the contact part of the lever body when the slider is in the second position.

According to aspects of the present invention, the contact part of the lever body and the lever contact member of the feeding guide, each may comprise corresponding inclined surfaces.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects of the present invention will become apparent, and more readily appreciated, from the following description of the exemplary embodiments, taken in conjunction with the accompanying drawings, of which.

DETAILED DESCRIPTION OF THE EXEMPLARY EMBODIMENTS

Figure 1:
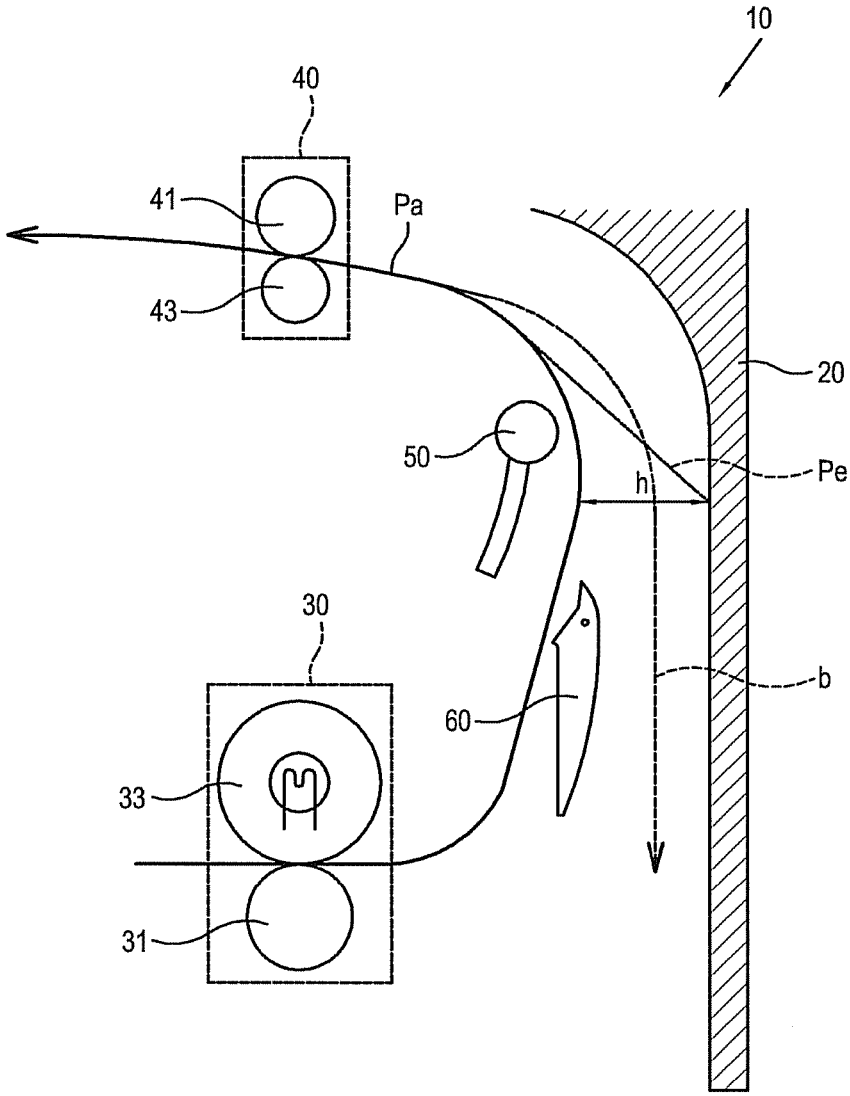
FIG. 1 (RELATED ART)
FIG. 1 is a schematic diagram illustrating a discharging process of a printing medium, in a conventional image forming apparatus.

Reference will now be made in detail to the exemplary embodiments of the present invention, examples of which are illustrated in the accompanying drawings, wherein like reference numerals refer to like elements throughout. The exemplary embodiments are described below, in order to explain the aspects of the present invention, by referring to the figures.

Figure 2:
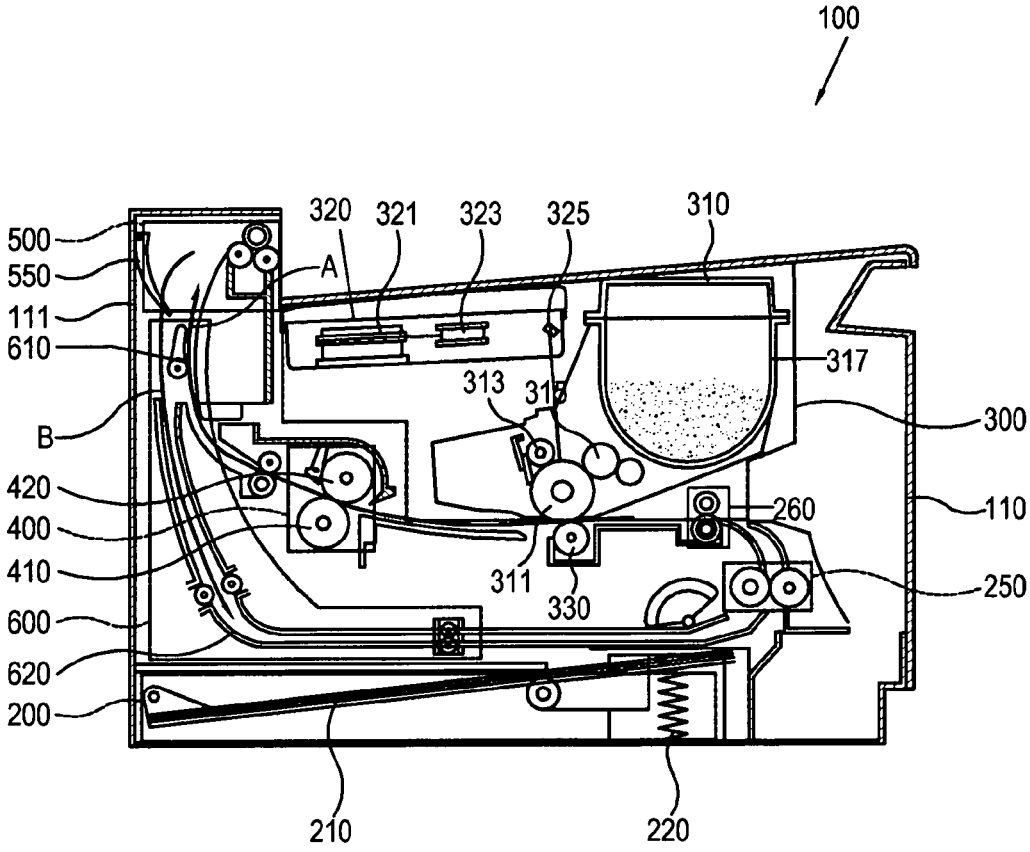
FIG. 2 is a schematic diagram illustrating a configuration of an image forming apparatus, according to an exemplary embodiment of the present invention.

As shown in FIG. 2, an image forming apparatus 100, according to an exemplary embodiment of the present invention, includes a casing 110, a printing medium supply unit 200, an image forming unit 300, a fusing unit 400, and a discharge unit 500. The image forming apparatus 100 further includes a back feeding unit to back feed a printing medium during duplex printing, but need not in all aspects. While not required, the image forming apparatus 100 can be included in a copier, facsimile machine, or a multifunctional device.

The printing medium supply unit 200 is detachably mounted to the casing 110, and supplies a printing medium to the image forming unit 300, in response to a printing signal. The printing medium supply unit 200 includes a main cassette (not shown), which is detachably mounted to the casing 110, a knock-up plate 210, which is provided to the main cassette, and on which a printing medium is loaded, a pickup roller 240, which picks up the printing medium from the knock-up plate 210, and an elastic member 220, which elastically biases the knock-up plate 210 toward the pickup roller 240.

While not required in all aspects, the shown printing medium supply unit 200 further includes at least a pair of feeding rollers 250 that feed the printing medium, which is picked-up by the pickup roller 240, to the image forming unit 300, along a feeding path of the printing medium. A registration roller 260 registers a leading edge of the printing medium, before the printing medium enters the image forming unit 300.

The printing medium supply unit 200 may further include an auxiliary cassette (not shown), which is detachably provided outside of the casing 110. The auxiliary cassette may increase the printing capacity of the image forming apparatus 100. The auxiliary cassette may be loaded with another type of printing medium, which has different characteristics than the printing medium loaded on the main cassette, for example, one-sided paper, an OHP film, a postcard, an envelope, or the like.

The image forming unit 300 deposits developer, on the printing medium supplied from the printing medium supply unit 200, to form a visible image. The image forming unit 300 includes a developing unit 310, which provides a developer to the printing medium, a transfer unit 330, which transfers the developer from the developing unit 310 to the printing medium, and a light exposing unit 320, which forms an electrostatic latent image, corresponding to image data, onto an image-bearing body 311, of the developing unit 310.

The developing unit 310 includes: the image-bearing body 311, which provides the developer to the printing medium; an electrifying member 313, which electrifies the image-bearing body 311 to a predetermined electric potential; a developer feeder 315, which feeds the developer to the electrostatic latent image of the image-bearing body 311; and a developer container 317. While not required in all aspects, all or portions of the developer 310 can be detachable and/or refillable when the developer runs out.

The transfer unit 330 opposes the image-bearing body 311, and applies a transfer voltage to a surface of the printing medium, to thereby transfer the developer from the image-bearing body 311, to the printing medium. The transfer voltage is supplied from a power supply (not shown), and is generally determined in advance, according to the thickness and resistance characteristics of the printing medium. The polarity of the transfer voltage is opposite to the polarity of the developer, so as to transfer the developer from the image-bearing body 311, to the printing medium. The transfer unit 330 is supplied with a voltage that is higher than a voltage of a light exposure area of the image-bearing body 311.

The light exposing unit 320 includes a plurality of optical devices, such as, a light source 323 that emits light, a polygon mirror 321, and a reflection mirror 325. The polygon mirror 321 has a plurality of reflection faces, and reflects the light from the light source 323 in a sub-scanning direction, to the image-bearing body 311.

The fusing unit 400 applies heat and pressure to the printing medium, to fuse the developer onto a surface of the printing medium. The fusing unit 400 includes a heating member 420, which heats the printing medium, and a pressing roller 410 provided in opposition to the heating member 420, which elastically presses the printing medium. Several pressing rollers 410 may be provided, to increase a nip area against the heating roller 420.

The back feeding unit back feeds the printing medium, so as to form an image on a second surface thereof. The back feeding unit includes a back feeding guide 620, which guides the printing medium toward the image forming unit 300, and a direction change lever 610, which changes a feeding direction of the printing medium, so that the printing medium positioned at a discharging part 520 (to be described later) of the discharge unit 500, can be back fed to the back feeding guide 620, if duplex printing is selected by a user.

The discharge unit 500 discharges the printing medium out of the casing 110, or back feeds the printing medium to the image forming unit 300, via the back feeding guide 620, for duplex printing. As shown in FIGS. 3C, 3D, 4C, and 4D, the discharge unit 500 includes: a feeding roller 510, which forward feeds the printing medium from the fusing unit 400; the discharging part 520, which discharges the printing medium to the outside; a feeding guide 550, which is provided between the direction change lever 610 (of FIG. 2) and the discharging part 520, and which moves between a discharging position and a back feeding position, to guide the printing medium; and a pressing lever 540, which is provided between the discharging part 520 and the feeding guide 550, and presses and releases the feeding guide 550, so that the feeding guide 550 can move between the discharging position and the back feeding position, depending on a movement of the discharging part 520. As shown in FIGS. 5A and 5B, the discharge unit includes a movement change part 530, which changes a rotational movement of a portion of the discharging part 520, to match a linear movement of the pressing lever 540.

The discharging part 520 discharges the printing medium, which is fed from the fusing unit 400, out of the casing 110, or back feeds the printing medium to the back feeding guide 620 (of FIG. 2), in the case of duplex printing. The discharging part 520 may include a pair of rollers that use a frictional force, or a belt that uses an electrostatic force, to discharge and/or back feed the printing medium.

As shown in FIGS. 3A to 4D, the discharging part 520 includes: a rotation shaft 521; a first discharging roller 522, which is rotatably coupled to the rotation shaft 521; a second discharging roller 523, which opposes the first discharging roller 522, and rotates according to the rotation of the first discharging roller 522; a support frame 524, which supports the second discharging roller 523; and a gear 527, which is provided on an end of the rotation shaft 521, and receives a rotational force from a driving part (not shown).

The movement change part 530 changes the rotational movement of the rotation shaft 521, to match the generally linear movement of the pressing lever 540. As shown in FIGS. 5A and 5B, the movement change part 530 includes: a worm gear 531, which is provided on the rotation shaft 521; and a slider 535, which is accommodated in a spiral groove 532 defined by the worm gear 531. The worm gear 531 changes the rotational movement of the rotation shaft 521 into the generally linear movement of the pressing lever 540.

The slider 535 slides in the spiral groove 532 as the rotation shaft 521 rotates. The slider 535 moves to a first position, for example, as illustrated shown in FIG. 5A, if the rotation shaft 521 rotates in a clockwise direction, and moves to a second position, as shown in FIG. 5B, if the rotation shaft 521 rotates in a counter-clockwise direction.

The slider 535 includes a slider body 535*a*, which slides in the spiral groove 532, and an coupling protrusion 535*b*, to which an biasing part 547 (FIG. 3C) is coupled. The slider body 535*a* has a height corresponding to the depth of the spiral groove 532.

The worm gear 531 comprises stoppers 533*a* and 533*b* disposed on opposing ends thereof, to stop the sliding movement of the slider 535 at the first and second positions. Although not shown, each of the stoppers 533*a* and 533*b* may have inclined portions. The slider 535 can keep sliding over the inclined portion, when at the first position, when the rotation shaft 521 rotates in a first direction. When the rotation shaft 521 rotates in a second direction, the slider 535 is eventually blocked by a back portion of the inclined part of the stopper 533*a* or 533*b* and is stopped at the second position. That is, the stoppers 533*a* and 533*b* may determine a starting point, in which the slider 535 moves from the first position to the second position, and vice versa.

The pressing lever 540 is moved along the rotation shaft 521, between the first and second positions, by the slider 535. The pressing lever 540 thereby moves the feeding guide 550 between the discharging position and the back feeding position. As shown in FIGS. 3A to 4D, the pressing lever 540 includes: a lever body 541, which accommodates the slider 535, and presses and releases the feeding guide 550; and the biasing part 547. The biasing part 547 is attached to the slider 535 and the lever body 541, and biases the slider 535 toward the worm gear 531, while preventing the lever body 541 from rotating.

Figure 3A:
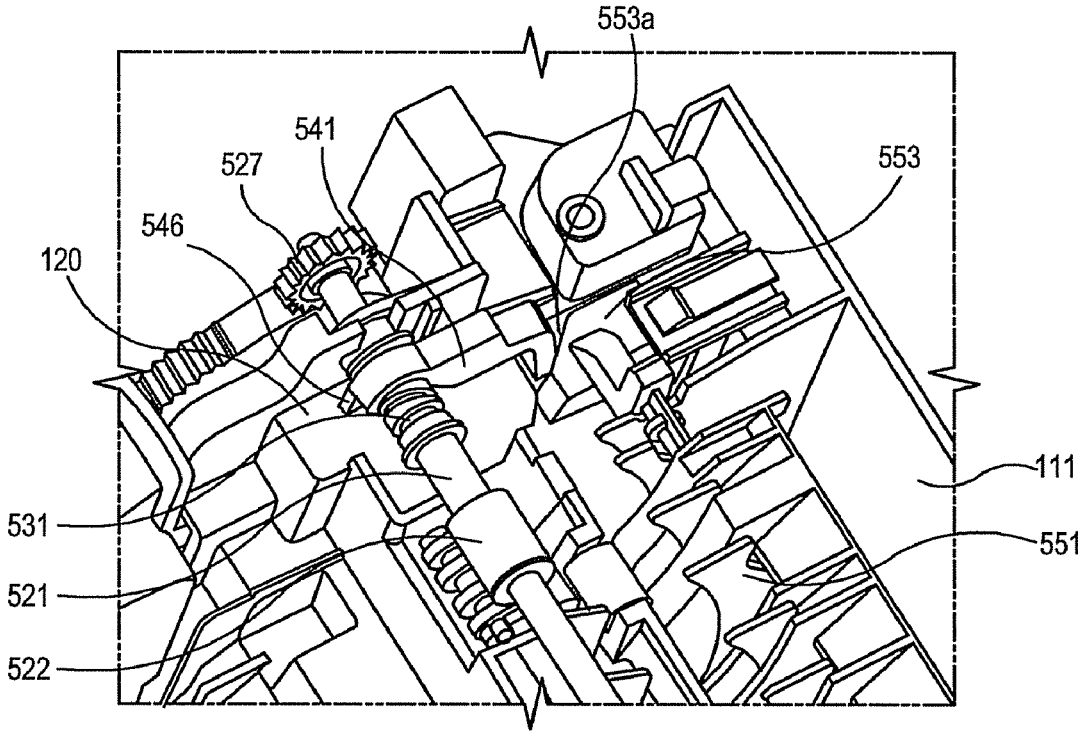
FIGS. 3A to 3D are schematic diagrams illustrating a discharge unit in a discharge position, in the image forming apparatus, according to the exemplary embodiment of the present invention.
Figure 3B:
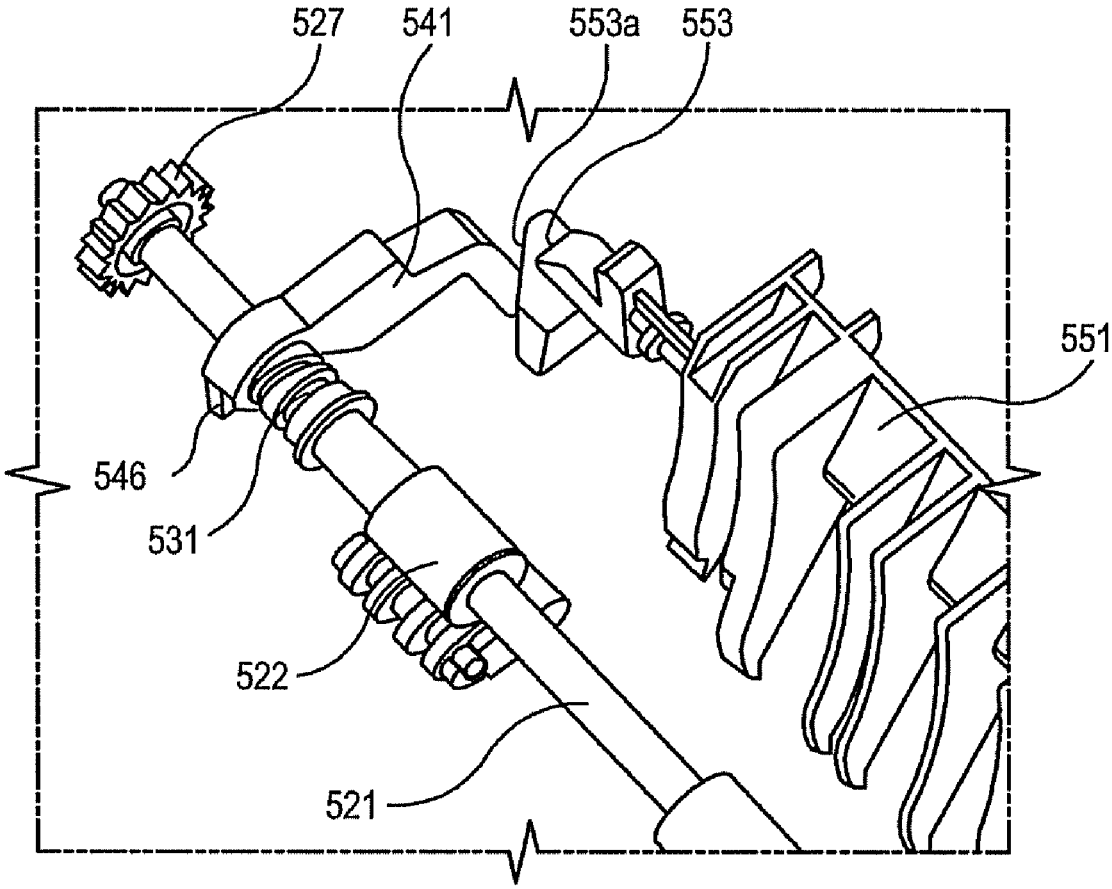
Figure 3C:
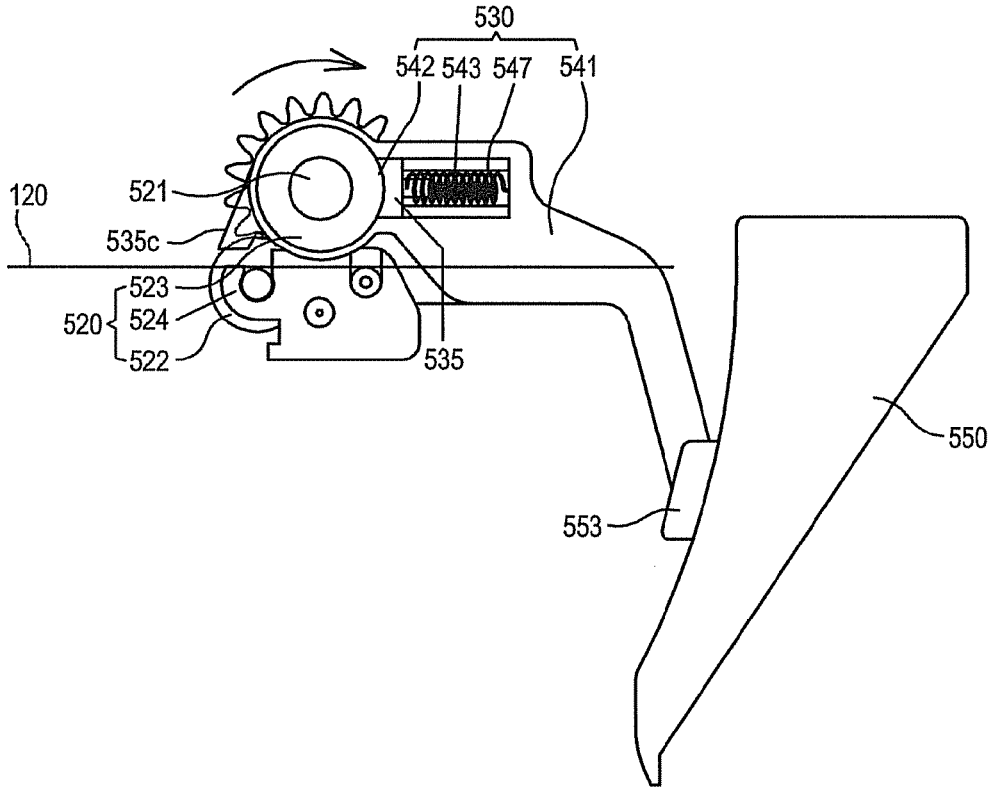
Figure 3D:
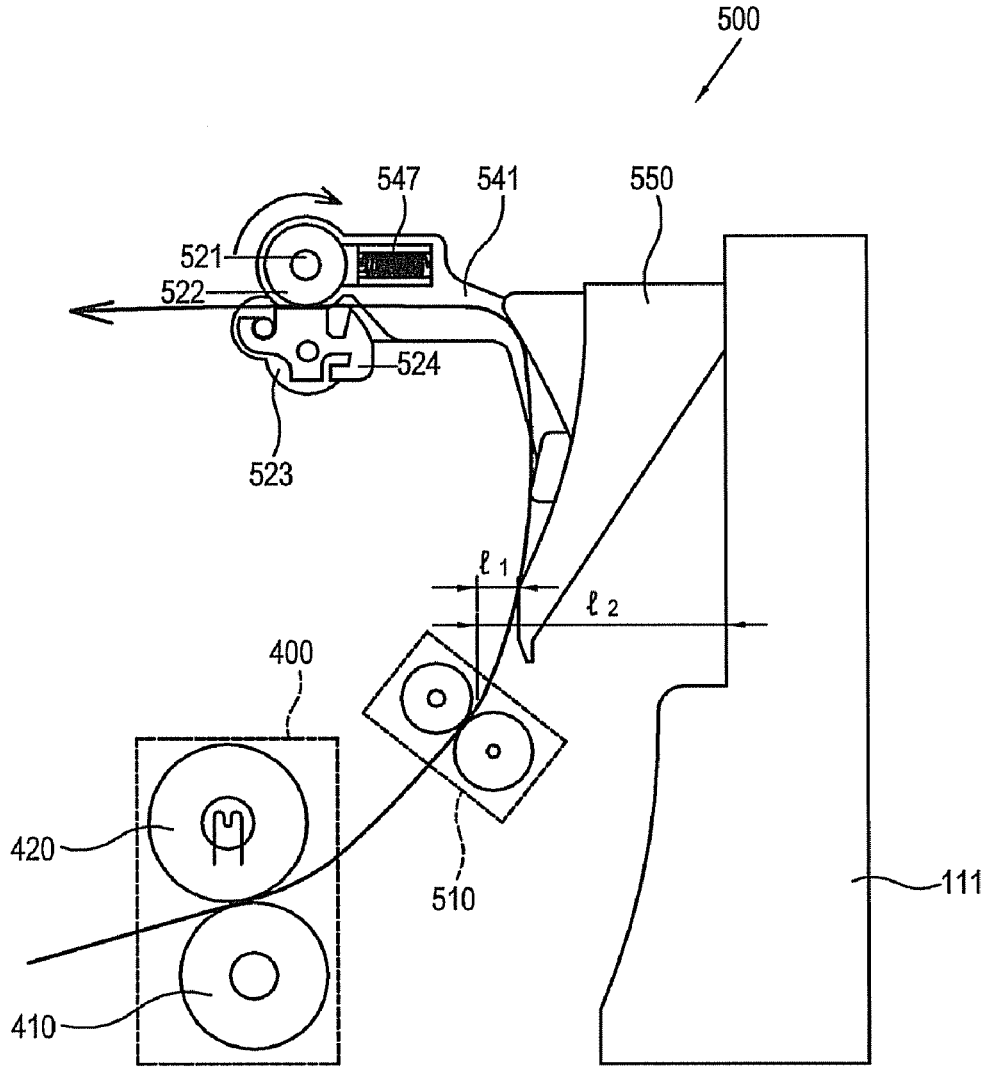
Figure 4A:
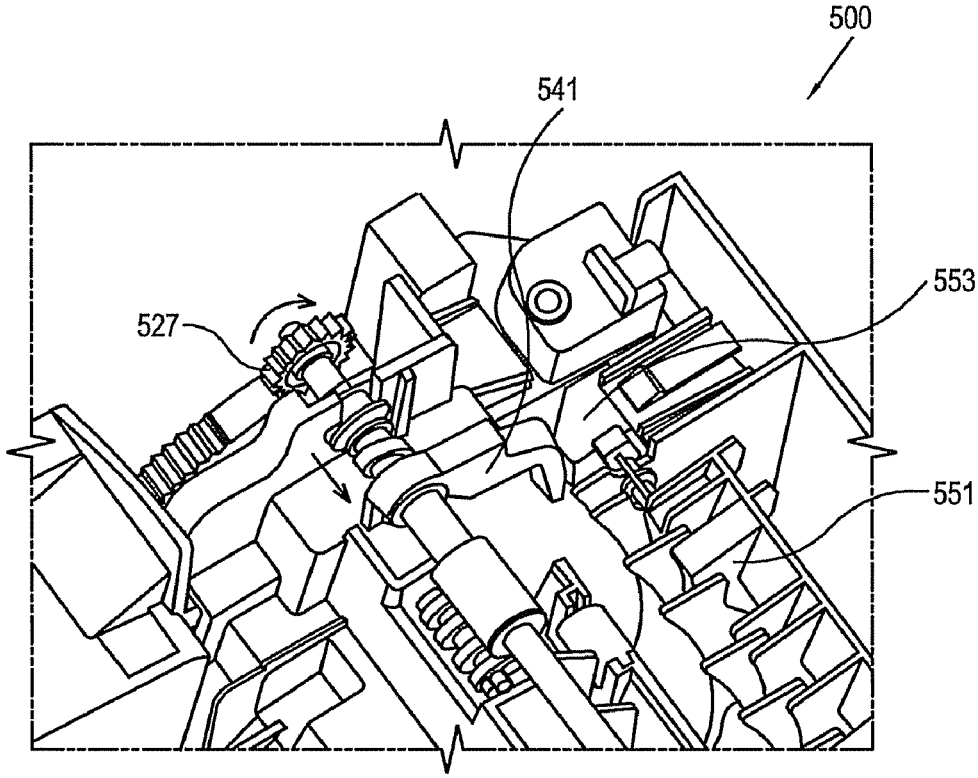
FIGS. 4A to 4D are schematic diagrams illustrating the discharge unit in a back feeding position, in the image forming apparatus, according to the exemplary embodiment of the present invention.
Figure 4B:
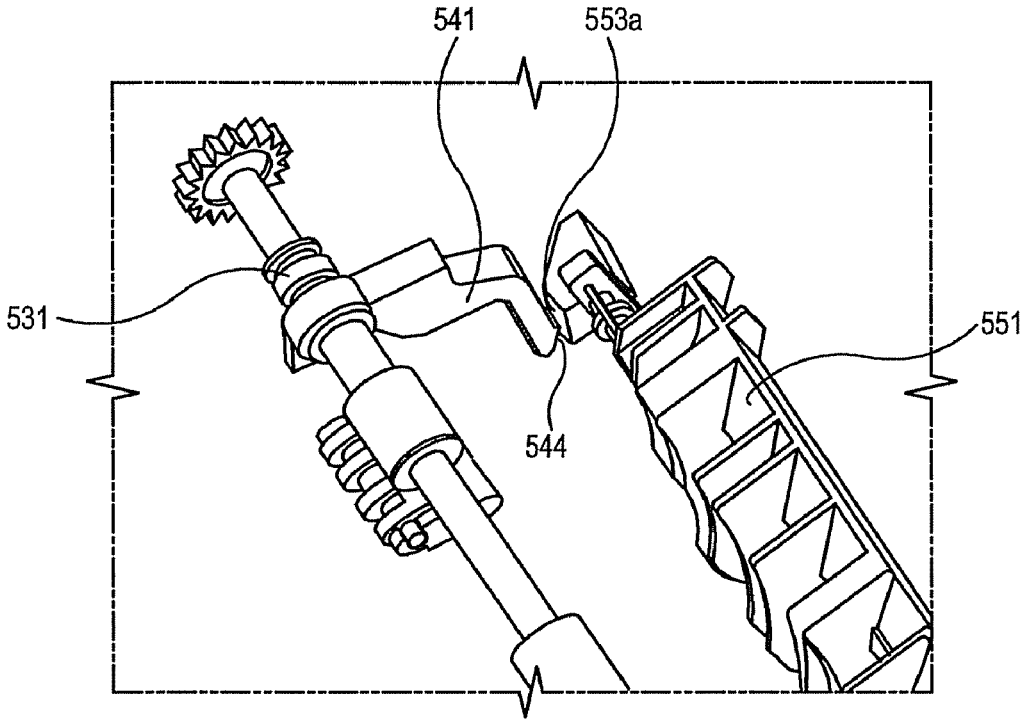

The lever body 541 accommodates the rotation shaft 521, as shown in FIGS. 3B, 3C, and 4B, and presses and releases a lever contact member 553 of the feeding guide 550. The lever body 541 is formed with a shaft accommodating hole 542, which accommodates the rotation shaft 521, and a coupling hole 543, into which the biasing part 547 is coupled. The lever body 541 is also formed with a rotation regulating rib 546, which regulates the movement of the lever body 541, so that the lever body 541 can move linearly along the rotation shaft 521 without rotation.

The shaft accommodating hole 542 has a shape and a size corresponding to the rotation shaft 521, and supports the slider 535 accommodated in the spiral groove 532. The coupling hole 543 communicates with the shaft accommodating hole 542, and accommodates the coupling protrusion 535*b*, so that the coupling protrusion 535*b* can be coupled with the biasing part 547.

As shown in FIGS. 3A, 3B and 3C, the rotation regulating rib 546 protrudes from the lever body 541, and regulates the movement of the lever body 541, by contacting a frame 120, when the lever body 541 moves toward the feeding guide 550 (refer to FIG. 3C), due to the rotation of the rotation of the rotation shaft 521. Thus, the lever body 541 does not rotate, but moves linearly between the first and second positions, depending on the movement of the slider 535. When the rotation shaft 521 rotates in a clockwise direction, the lever body 541 directly contacts the frame 120, to thereby prevent a rotation of the lever body 541.

Figure 4C:
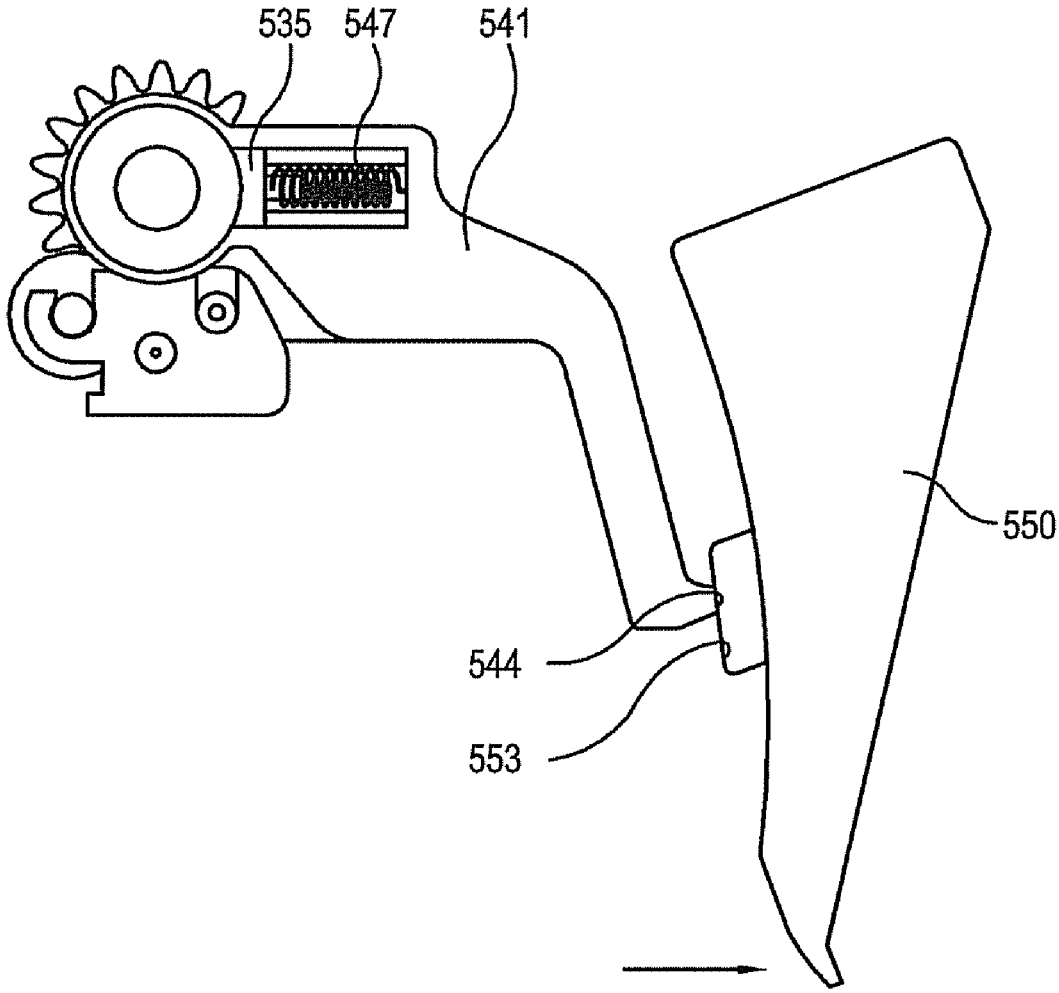
Figure 5A:
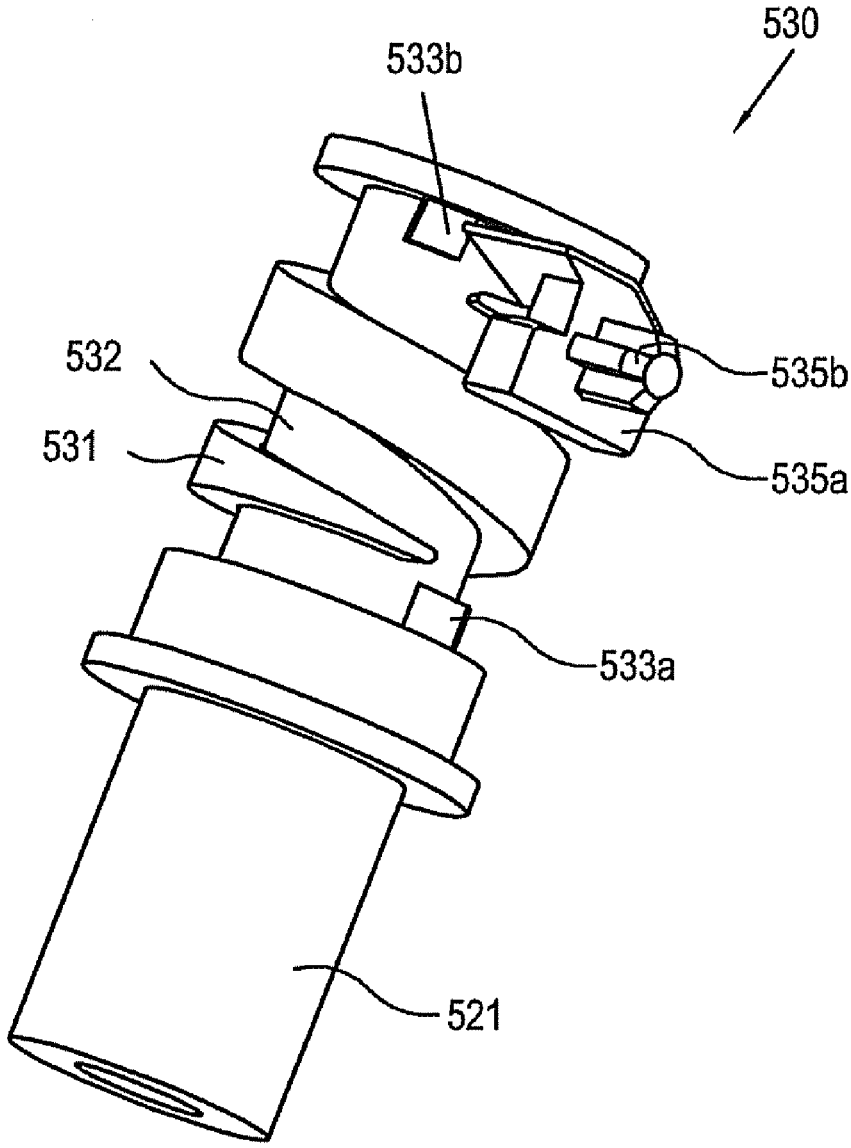
FIGS. 5A and 5B are schematic diagrams illustrating a movement change part in a first position and a second position, in the image forming apparatus, according to an exemplary embodiment of the present invention.
Figure 5B:
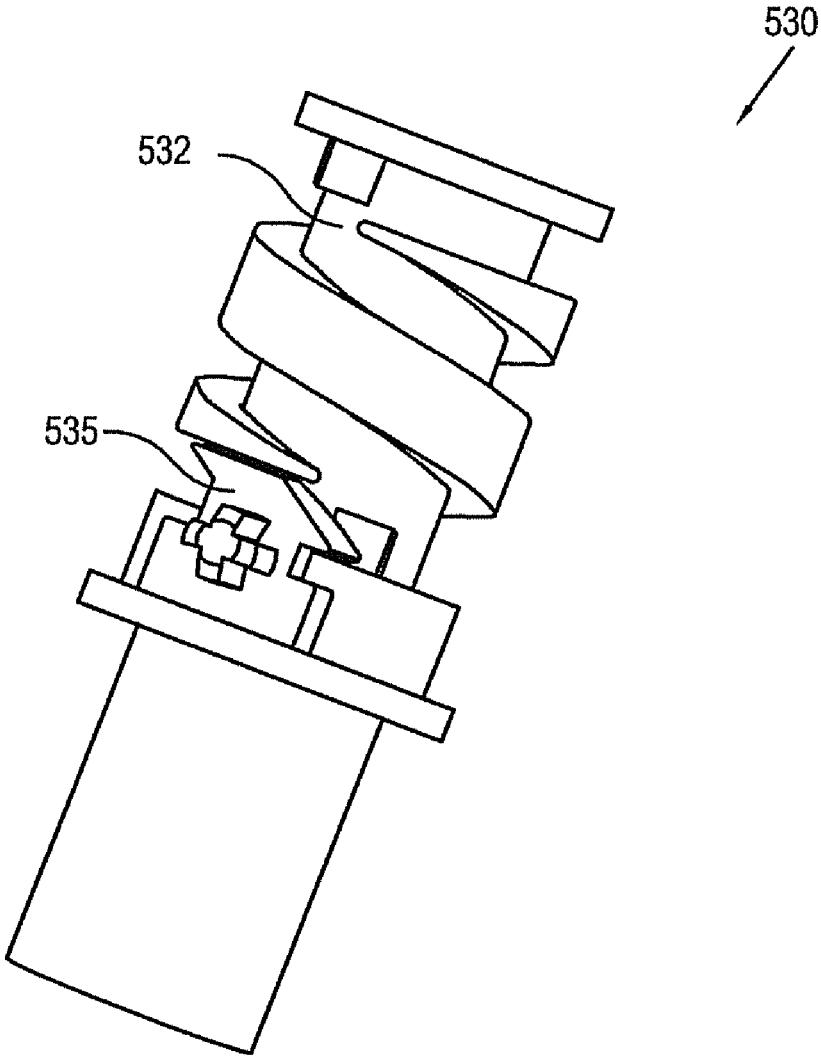

As shown in FIG. 4C, the lever body 541 includes a contact part 544 that extends from the lever body 541, and is bent toward the feeding guide 550. The contact part 544 contacts a lever contact member 553 of the feeding guide 550, while in the first position. The contact part 544 can be inclined, to smoothly contact the lever contact member 553.

The biasing part 547 is accommodated in the coupling hole 543 of the lever body 541, and biases the slider 535 toward the spiral groove 532. The bias applied to the slider 535 couples the lever body 541 to the slider 535.

The feeding guide 550 moves between the discharging position (refer to FIG. 3C), in which the printing medium is discharged, and the back feeding position (refer to FIG. 4C), in which the printing medium is back fed to the back feeding guide 620 (of FIG. 2), depending on movement of the pressing lever 540. The feeding guide 550 is rotatably coupled to the casing 110.

The feeding guide 550 includes a feeding guide body 551, which moves toward and away from the pressing lever 540 while rotating, and the lever contact member 553, which extends from a rotation shaft (not shown) of the feeding guide body 551. The lever contact member 553 contacts the contact part 544 of the pressing lever 540. The feeding guide body 551 may have a curved surface, or an inclined surface, to guide the printing medium toward the discharging part 520, while in the discharging position.

As shown in FIGS. 3A and 4A, the lever contact member 553 has an inclined surface 553*a* corresponding to a surface of the contact part 544, so as to smoothly slide in contact with the contact part 544. The smaller the inclination angle of the inclined surface, relative to the surface of the contact part 544, the more smoothly the feeding guide 550 can move. The feeding guide 550 may further include a biasing member (not shown) to restore the feeding guide body 551, from the back feeding position to the discharging position.

A printing medium feeding process of the image forming apparatus having the above-described configuration will be described with reference to FIGS. 2 to 5B. A printing medium feeding process, in the case of one-sided printing, will now be described. The printing medium to moves along a feeding path A, as shown in FIG. 2, through developing unit 310 and the fusing unit 400. The change lever 610 rotates towards the discharging part 520, to open the feeding path A.

In the discharge unit 500, the rotation shaft 521 rotates according to the rotation of the gear 527. The slider 535, which is accommodated in the spiral groove 532 of the worm gear 531, moves from the first position, as shown in FIG. 5A, to the second position, as shown in FIG. 5B. Then, the lever body 541, which is coupled with the slider 535, moves to the second position along the rotation shaft 521, as shown in FIG. 3A. The contact part 544 of the lever body 541 separates from the lever contact member 553, and the feeding guide 550 moves to the discharging position, in which the feeding guide 550 moves away from a wall surface 111 of the casing 110, and adjacent to the feeding path A. Accordingly, a distance 11, between the feeding roller 510 and the feeding guide 550, is smaller than a distance 12, between the feeding roller 510 and the wall surface 111 of the casing 110. That is, a space, in which the trailing edge of the printing medium collides with the wall surface 111 of the casing 110, is significantly reduced, to thereby reduce noise, and to stably guide the printing medium to the discharging part 520.

A printing medium feeding process, in the case of duplex printing, will now be described. The slider 535, moves from the second position shown in FIG. 5B, and is stopped by the stopper 533*b* at the first position in the spiral groove 532, according to the reverse rotation of the rotation shaft 521 (shown in FIG. 5A). Accordingly, the lever body 541 is moved to the first position (shown in FIG. 4D). The contact part 544 of the lever body 541 presses against the lever contact member 553, as shown in FIG. 4B. Accordingly, the lever contact member 553 moves toward the wall surface 111 of the casing 110.

Figure 4D:
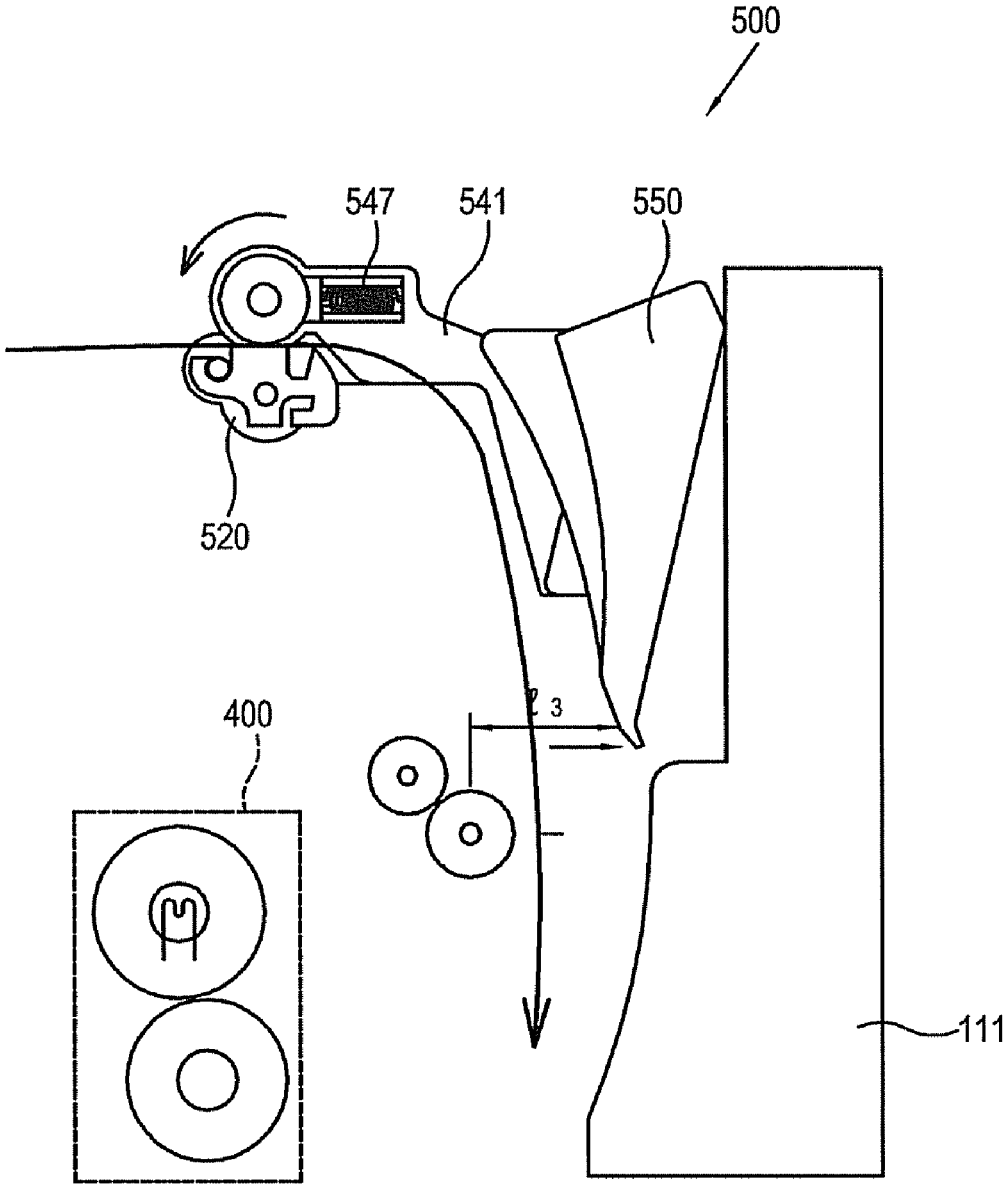

The feeding guide body 551 moves, as shown in FIGS. 4C and 4D, according to the movement of the lever contact member 553. The trailing edge of the printing medium is positioned in the discharging part 520, and moves toward the back feeding guide 620, according to the reverse rotation of the rotation shaft 521, as shown in FIG. 4D. Since the feeding guide 550 moves toward the wall surface of 111 of the casing 110, a distance I3, between the feeding roller 510 and the feeding guide 550, is increased. Accordingly, the printing medium can be stably fed back through the increased space, toward the back feeding guide 620.

As described above, in a discharge unit and an image forming apparatus having the same, a feeding guide moves between a discharging position, in which the printing medium is discharged, and a back feeding position, in which the printing medium is back fed toward a back feeding guide. Accordingly, a distance between a discharging roller and the feeding guide is significantly decreased in the discharging position, to thereby reduce noise generated when the printing medium is discharged. Also, the feeding guide moves toward a casing, to create sufficient space to back feed the printing medium, to thereby prevent a jam of the printing medium. The feeding guide moves according to the rotation of a discharging part, to thereby achieve a simplified structure.

Although a few exemplary embodiments of the present invention have been shown and described, it will be appreciated by those skilled in the art that changes may be made in these embodiments, without departing from the principles and spirit of the invention, the scope of which is defined in the claims and their equivalents.

What is claimed is:

1. An image forming apparatus comprising:

a casing;

a printing medium supply unit coupled to the casing, to supply a printing medium;

an image forming unit to form an image on the printing medium supplied from the printing medium supply unit;

a discharging part to discharge the printing medium from the image forming unit, out of the casing, and to back feed the printing medium to the image forming unit for duplex printing according to rotation of a rotation shaft;

a back feeding unit comprising:

a back feeding guide, and a direction change lever to change a feeding direction of the printing medium so printing medium positioned at a discharging part can be back fed to the back feeding guide for duplex printing;

a feeding guide between the direction change lever and the discharging part, along a feeding path of the printing medium, to move to a discharging position having a distance between a feeding roller and the feeding guide being less than a distance between the feeding roller and a wall surface of the-casing to guide the discharge of the printing medium out of the casing, and to move to a back feeding position to guide the back feed of the printing medium to the image forming unit, the feeding guide being coupled to the casing; and a pressing lever to press and release the feeding guide, according to a movement of the discharging part, such that the feeding guide moves between the discharging position and the back feeding position, wherein the pressing lever moves in a longitudinal direction of the rotation shaft to press and release the feeding guide.

2. The image forming apparatus according to claim 1, wherein a bottom tip of the feeding guide is further from the casing when in the discharging position, and is closer to the casing when in the back feeding position.

3. The image forming apparatus according to claim 2, wherein when the feeding guide is in the back feeding position, the pressing lever contacts the feeding guide, and when the feeding guide is in the discharging position, the pressing lever is spaced apart from the feeding guide.

4. The image forming apparatus according to claim 3, wherein the discharging part comprises:

the rotation shaft; and a discharging roller coupled to the rotation shaft, to discharge the printing medium.

5. The image forming apparatus according to claim 4, further comprising a movement change part disposed between the discharging part and the pressing lever, to change a rotational movement of the rotation shaft into a linear movement of the pressing lever.

6. The image forming apparatus according to claim 5, wherein the movement change part comprises:

a worm gear disposed on the rotation shaft; and a slider disposed between the worm gear and the pressing lever, to slide between a first position that corresponds to the back feeding position, and a second position that corresponds to the discharging position.

7. The image forming apparatus according to claim 6, wherein the worm gear comprises a stopper to regulate the movement of the slider.

8. The image forming apparatus according to claim 7, wherein the pressing lever comprises:

a lever body disposed to move with the slider; and a biasing part disposed between the lever body and the slider, to bias the slider toward the worm gear.

9. The image forming apparatus according to claim 8, wherein the lever body comprises a contact part to contact the feeding guide when the slider is in the first position on the rotation shaft, and to be spaced apart from the feeding guide when the slider is in the second position on the rotation shaft.

10. The image forming apparatus according to claim 9, wherein the feeding guide comprises:

a rotatable feeding guide body; and a lever contact member that extends from the feeding guide body, to contact the contact part of the lever body, when the slider is in the first position, and to be spaced from the contact part of the lever body, when the slider is in the second position.

11. The image forming apparatus according to claim 10, wherein the contact part of the lever body and the lever contact member of the feeding guide each comprise corresponding inclined surfaces.

12. A discharge unit for an image forming apparatus that comprises:

a casing;

a printing medium supply unit coupled to the casing, to supply a printing medium; and an image forming unit to form an image on the printing medium, the discharge unit comprising:

a discharging part to discharge the printing medium from the casing;

a back feeding unit comprising:

a back feeding guide, and a direction change lever to change a feeding direction of the printing medium so printing medium positioned at a discharging part can be back fed to the back feeding guide for duplex printing according to rotation of a rotation shaft;

a feeding guide disposed along a feeding path of the printing medium between the direction change lever and the discharging part, to move to a discharging position having a distance between a feeding roller and the feeding guide being less than a distance between the feeding roller and a wall surface of the casing to discharge the printing medium out of the casing, and to a back feeding position to back feed the printing medium to the image forming unit, the feeding guide being coupled to the casing; and a pressing lever to press and release the feeding guide, according to movements of the discharging part, such that the feeding guide moves between the discharging position and the back feeding position, wherein the pressing lever moves in a longitudinal direction of the rotation shaft to press and release the feeding guide.

13. The discharge unit according to claim 12, wherein a bottom tip of the feeding guide is further from the casing when in the discharging position, and is closer to the casing when in the back feeding position.

14. The discharge unit according to claim 13, wherein when the feeding guide is in the back feeding position, the pressing lever contacts the feeding guide, and when the feeding guide is in the discharging position, the pressing lever is spaced apart from the feeding guide.

15. The discharge unit according to claim 14, wherein the discharging part comprises:

the rotation shaft, and a discharging roller disposed in contact with the rotation shaft, to feed the printing medium.

16. The discharge unit according to claim 15, wherein the image forming apparatus further comprises a movement change part disposed between the discharging part and the pressing lever, to change a rotational movement of the rotation shaft into a linear movement of the pressing lever.

17. The discharge unit according to claim 16, wherein the movement change part comprises: a worm gear disposed on the rotation shaft; and a slider disposed between the worm gear and the pressing lever, to slide between a first position corresponding to the back feeding position, and a second position corresponding to the discharging position.

18. The discharge unit according to claim 17, wherein a lever body comprises a contact part to contact the feeding guide, when the slider is positioned in the first position on the rotation shaft, and to be spaced apart from the feeding guide, when the slider is positioned in the second position on the rotation shaft.

19. The discharge unit according to claim 18, wherein the pressing lever comprises:

a lever body which moves together with the slider; and a biasing part to bias the slider toward the worm gear.

20. A discharge unit for an image forming apparatus that comprises:

an image forming unit to form an image on a printing medium, the discharge unit comprising:

a roller to discharge a printing medium from the image forming apparatus, and to back feed the printing medium back into the image forming unit;

a rotation shaft to rotate the roller in a first direction to discharge the printing medium, and to rotate the roller in a second direction to back feed the printing medium;

a back feeding unit comprising:

a back feeding guide, and a direction change lever to change a feeding direction of the printing medium so printing medium positioned at a discharging part can be back fed to the back feeding guide for duplex printing according to rotation of the rotation shaft;

a movement change part to move according to the rotation of the rotation shaft; and a feeding guide disposed along a feeding path of the printing medium between the direction change lever and discharging part, to move to a discharging position having a distance between a feeding roller and the feeding guide being less than a distance between the feeding roller and a wall surface of the casing to guide the discharging the printing medium as the rotation shaft rotates in the first direction, and to move to a back feeding position to guide the back feeding of the printing medium to the image forming unit as the rotation shaft rotates in the second direction, according to movements of the movement change part, the feeding guide being coupled to the casing, wherein the discharging position is relatively closer to the feeding path than the back feeding position, wherein the pressing lever moves in a longitudinal direction of the rotation shaft to press and release the feeding guide.

21. The discharge unit of claim 20, further comprising a pressing lever to press and release the feeding guide, according to movements of the rotation shaft, such that the feeding guide moves between the discharging position and the back feeding position.

22. The discharge unit of claim 21, wherein the pressing lever comprises a rotation regulating rib to control a rotation of the pressing lever.

23. The discharge unit of claim 20, wherein the movement change part comprises:

a slider disposed adjacent to the rotation shaft, to move the feeding guide; and a worm gear disposed on the rotation shaft, to move the slider according to the rotation of the rotation shaft.

24. The discharge unit of claim 23, wherein the movement change part further comprises at least one stopper, to stop the slider at a first position corresponding to the discharging position, and at a second position corresponding to the back feeding position.

* * * * *